US007462822B2

(12) United States Patent
Gebhardt et al.

(10) Patent No.: US 7,462,822 B2
(45) Date of Patent: Dec. 9, 2008

(54) APPARATUS AND METHOD FOR THE TRANSPORT OF IONS INTO A VACUUM

(75) Inventors: Christian Gebhardt, Bremen (DE); Andreas Brekenfeld, Bremen (DE); Jochen Franzen, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 325 days.

(21) Appl. No.: 11/343,922

(22) Filed: Jan. 31, 2006

(65) Prior Publication Data

US 2006/0186329 A1 Aug. 24, 2006

(30) Foreign Application Priority Data

Feb. 3, 2005 (DE) ..... 10 2005 004 885

(51) Int. Cl.
*H01J 49/26* (2006.01)

(52) U.S. Cl. ..... 250/288

(58) Field of Classification Search ..... 250/288, 250/281, 282

See application file for complete search history.

(56) References Cited

U.S. PATENT DOCUMENTS 5,811,820 A * 9/1998 Kirchner et al. ..... 250/432 R

* cited by examiner

*Primary Examiner*—Kiet T Nguyen
(74) *Attorney, Agent, or Firm*—Law Offices of Paul E. Kudirka

(57) ABSTRACT

The invention relates to methods and devices for the transport of ions generated in gases near atmospheric pressure into the vacuum system of a mass spectrometer. Instead of the single capillary customary in commercial instruments, the invention uses a multichannel plate with hundreds of thousands of very short and narrow capillaries, whose total gas throughput is no higher than that of a normal single capillary. The large-area take-up of ions in the gas flow greatly increases the transfer yield. If the channels are conductive, this prevents the inside surfaces becoming charged. An ion funnel can separate the ions from the gas flow in the vacuum and focus them. Gas-dynamic focusing in an electric decelerating field reduces ion losses caused by wall collisions and prevents very light ions (protons, water clusters) from entering the vacuum. Staged multichannel plates reduce pumping requirements.

20 Claims, 2 Drawing Sheets

APPARATUS AND METHOD FOR THE TRANSPORT OF IONS INTO A VACUUM

FIELD OF THE INVENTION

The invention relates to methods and devices for the gas-assisted transport of ions from pressures near atmospheric pressure into a vacuum system, e.g., the vacuum system of a mass spectrometer.

BACKGROUND OF THE INVENTION

Different types of devices are available to transport ions from one location to another, these devices being adapted to the pressure conditions of the surroundings. For transport in the vacuum there are several satisfactory solutions, including solutions which allow the ions to be focused to a beam in the axis of the transport system. For targeted, concentrated transport of ions in air or gases at atmospheric pressure, however, the only options are transport with the flowing gas or the phenomenon of ion mobility, by means of which ions drift through the gas along electric lines of force, being constantly decelerated by the gas. Neither type of transport can achieve a narrow focusing of the ions. Especially for targeted transport of ions located in a relatively large cloud in ambient air, no transport system with sufficiently low losses for transporting the ions into the vacuum of a mass spectrometer has yet been found.

In a very good high vacuum, ions can be transported in ion guides comprising an external tube and a thin wire mounted in the axis. A potential difference between wire and tube creates a field arrangement in which ions can be transported in the tube along the axis, the ions executing Kepler type motions around the wire beside their forward drift.

This type of ion guide cannot be used in a poorer vacuum, in which a moderate number of collisions with molecules of residual gas damp the motion of the ions, since the damped ions would be eventually discharged on the central wire. However, ion guides based on RF multipole rod arrangements according to Wolfgang Paul can be used very successfully here, since these form electric RF fields which accelerate the ions toward the axis of the rod arrangement. The damping of the oscillations transverse to the axis causes them to be collected eventually in the axis of the rod system. The ions can then be transported by residual gas in motion, or by space charge effects where, for example, the ions are removed at one end of the rod system by suction and are pushed on by the space charge effect.

Besides these rod systems, other ion guides have been described which can be operated with RF and additionally supplied with an axial potential difference, for example systems consisting of a large number of ring diaphragms arranged in parallel, or double helix systems (U.S. Pat. No. 5,572,035; J. Franzen). The axial potential difference guides the ions actively through the ion guide. A recently invented arrangement of parallel diaphragms with apertures of a very special shape makes it possible to collect the ions in the axis as well as actively transporting them forward (U.S. application Ser. No. 11/243,440; GB Application 0520291.6; J. Franzen et al.). A further variety of an ion guide is the ion funnel (U.S. Pat. No. 6,107,628; R. D. Smith and S. A. Shaffer), which can collect ions at pressures below one kilopascal from a relatively large cloud, free them to a large extent from the gas following behind and focus them. It consists of ring diaphragms whose apertures have tapering inside diameters and an axial potential difference.

Ions can survive for any length of time in air or other gases if the energy for ionizing them is greater than the energy for ionizing the ambient gases, and if neither ions of the opposite polarity nor electrons are available for recombinations. Ions can be transported through gases using electric fields, in which case the laws of ion mobility apply, according to which the ions move along the electric lines of force, being continuously decelerated and their direction being only slightly affected by diffusion motion.

The ions can also be transported by the moving ambient gas itself, however. If gas is forced through a tube or capillary, ions are viscously entrained in the gas. It is thus known that ions generated outside the vacuum system can be guided through a capillary into the vacuum of a mass spectrometer. When the ions are being transported through capillaries, however, they must be prevented from colliding with the wall, since these wall collisions generally discharge the ions and hence destroy them.

It is known from capillary chromatography that all the molecules of a gas that moves through a capillary suffer an extraordinarily high number of wall collisions. The number of wall collisions essentially corresponds to the number of the theoretical (vaporization) plates which represent the separation efficiency of chromatographic columns. In capillary columns it is extremely high. A rough rule of thumb for the best possible gas speed (the "van Deemter" speed) is that a molecule statistically collides once with the wall after a path which corresponds to the diameter of the capillary. For higher gas speeds, the number of wall collisions per unit of path length decreases. The wall collisions, however, are not evenly distributed along the capillary. Time and again there are long paths with no wall collisions, alternating with paths with much more frequent wall collisions. It follows that only those ions which happen to cover a long path without coming into contact with the wall can get through a capillary undamaged. It may be assumed that these ions have entered the capillary centrally.

The phenomenon of ion transport in capillaries was investigated in the paper "Ion Transport by Viscous Gas Flow through Capillaries" by B. Lin and J. Sunner in J. Amer. Soc. Mass Spectr. 5, 873 (1994). In this paper, the authors initially refuted the widely held view that the ions can be focused by applying a charge to the capillary walls. Inside a capillary with uniformly charged walls there is a field-free drift region in which ions cannot be focused at all. There is no repulsion of the ions whatsoever when they approach the charged wall. The authors' experiments showed that the diffusion of the ions toward the walls does actually cause high losses to an extent which was theoretically to be expected, and that only a statistically expected residual number of the ions can pass undamaged through the capillary. The yield of transported ions decreases with the length of the capillary, and there is a similar drastic reduction for thinner capillaries. A further loss occurs especially because of space charge effects, whose Coulomb repulsion drives the ions to the capillary walls. The space charge effect limits the transport of ions through such single capillaries.

It is also known that it is even possible to pump the ions against a potential difference by viscous entrainment of the ions in the gas stream, as described in the article "Electrospray Interface for Liquid Chromatographs and Mass Spectrometers" by C. Whitehouse et al., Anal. Chem. 1985, 57, 675. This is already used in commercially available instruments. This can be used to pump the ions up to an acceleration potential inside a mass spectrometer, for example; or the needle of an electrospray unit can be set to ground potential for safety reasons, and the inlet of the capillary can be set to spray potential.

In patent DE 195 15 271 C2 (J. Franzen, which corresponds to GB 2 300 295 B, U.S. Pat. No. 5,736,740 A) a gas-dynamic focusing is suggested, which has to occur when ions are transported against a potential difference in a capillary. The gas-dynamic focusing comprises a circulation lift of a molecule located close to the wall in the parabolic velocity profile of the gas flow and executes an ion mobility motion in the backward direction.

If a decelerated ion is not in the axis of the capillary, it experiences a slightly slower velocity of gas circulation on the side near the wall than on the side toward the central axis. Bernoulli's laws mean that this slight difference makes itself felt in a so-called circulation lift, which is directed toward the side of the higher gas speed, i.e., toward the axis. (The circulation lift of an aircraft wing, which keeps the aircraft in the air, is a well-known phenomenon, although generated in a slightly different way.) This gas-dynamic focusing power opposes the random diffusion motion of an ion toward the wall and brings the ion back to the axis of the capillary. The focusing power is proportional to the difference of the squares of the circulation speeds on both sides of the ion, and therefore increases, the greater the deceleration. It is not present when the ion moves at the speed of the ambient gas.

It has not yet proved possible to definitely detect this focusing effect as such, but the lower cut-off limit for ions of too low a mass-to-charge ratio associated with this effect has been detected. The focusing effect is expectably very small and very inferior to opposing space charge effects. The gas-dynamic focusing can therefore only be effective when no space charge effects whatsoever are present.

The paper "Improved Ion Transmission from Atmospheric Pressure to High Vacuum Using a Multicapillary Inlet and Electrodynamic Ion Funnel Interface" by T. Kim et al., Anal. Chem., 72, 5014-5019 (2000) describes how a bundle of seven identical metal capillaries can achieve much more than seven times the ion transport of a single metal capillary with the same dimension, soldered into the same kind of block, although the seven capillaries have to be equipped with a more powerful pump system in order to achieve roughly the same pressure in the ion funnel. How the bundle of seven capillaries achieves the 10- to 20-fold ion transport is as yet unexplained. Nor has it been explained how two different bundles whose individual capillaries have inside diameters of 0.51 and 0.43 millimeters respectively, and whose gas streams must differ mathematically by a factor of two, demonstrated a reduction of the ion transport of only 30 percent for the smaller diameter.

It can only be surmised that a mutual influencing of the gas streams means the inflow of the ions into the seven adjacent capillaries of the bundle is more organized than the inflow into a single capillary, and possibly leads to less turbulence in the inlet region of the capillary. That the organization of the gas at the capillary inlet is important is shown in the following paper: "Improved Capillary Inlet Tube Interface for Mass Spectrometry—Aerodynamic Effects to Improve Ion Transmission", D. Prior et al., Computing and Information Sciences 1999 Annual Report. The authors report that a slightly funnel-shaped widening of the capillary inlet leads to a fourfold increase in ion transmission from an electrospray ion source.

With the prior art only a small proportion of the generated ions in an enclosed gas stream can be transported undamaged at a time.

The gas in the vacuum system of a mass spectrometer generally makes it necessary to have a differential pump system with at least three pressure stages. Commercially available electrospray instruments incorporate these pressure stages. In the first differential pump stage there is a relatively high pressure of around one to three hectopascal, which greatly impedes the onward transmission of the ions. The ions are usually accelerated toward skimmers located opposite the end surface of the capillaries. This causes high focusing and scattering losses. The use of ion funnels, as described above, improves the ion transport through this first pressure stage. In the second pressure stage it is then possible to capture the ions effectively, for example using an ion guide made of a multipole arrangement with long pole rods.

SUMMARY OF THE INVENTION

The invention provides a multichannel plate for the ion transport from near atmospheric pressure into a vacuum system instead of the single capillary that has been exclusively used in commercial instruments until now. Multichannel plates have been used as secondary-electron multipliers for ion detectors; they contain many thousands, or hundreds of thousands, of very narrow single channels passing through relatively thin plates. They are usually made of glass and have high-resistance layers on the interior walls of the channels. The channels generally have inside diameters of less than ten micrometers. Favorable inside diameters are around five micrometers.

Multichannel plates can be designed so that the gas inflow is about the same as the gas inflow through a single capillary despite these plates having hundreds of thousands of very short channels. Example: According to Poiseuille's law (also known as the Hagen-Poiseuille law) for compressive media, a single capillary with an inside diameter of 0.5 millimeters and 160 millimeters in length, and a multichannel plate only one millimeter thick having 500,000 channels, each with an inside diameter of 5 micrometers, have the same gas throughput if the pressure difference is the same. With extremely close spacing, the channels can occupy an area of around six square millimeters on the plate surface only. With larger spacing they can be spread over a larger area. Another example: For a multichannel plate 0.3 millimeters thick, around 150,000 microchannels covering a minimum area of some two square millimeters produce the same flow of gas. Larger channel-to-channel distances result in a multichannel plate with higher mechanical strength; it also has advantages for advancing the ions, which do not have to be especially focused.

The dwell time of the ions in the one millimeter long microchannels is around one third of the dwell time of the ions in the single capillary which is a little less than a millisecond. This means that essentially similar conditions are present for desolvation and other processes which take place in the capillaries. For a thin multichannel plate 0.3 millimeters thick, this results in ion dwell times in the microchannels of around only one tenth of a millisecond.

The space charge effect becomes considerably less important in the multichannel plates: If, at any time, there is only a single ion in each of the microchannels from the above examples, i.e., if there is absolutely no Coulomb repulsion between the ions, then around one billion ions per second can enter the vacuum. In a single capillary this would lead to great crowding: around ten thousand ions would crowd per millimeter of the capillary, leading to such a strong repulsion that within a few microseconds most of the ions would be driven to the wall.

The high-resistance coating means it is not only possible to prevent the interior walls of the channels from becoming charged due to the occasional impact of ions, it is, furthermore, also possible to generate uniform potential gradients which can be used for a gas-dynamic focusing. In the absence of space charge repulsions, the above-described gas-dynamic focusing can become effective and keep the ions away from the walls.

The microchannels of the multichannel plate have a better (smaller) length to diameter ratio than the single capillary. If the ions in the flowing gas have the same angle of diffusion, the ions in the microchannels of the multichannel plate have more chance of flying undamaged through the microchannels, even in the absence of gas-dynamic focusing. The surprisingly high efficiency of the multichannel plate is also particularly attributable to the fact that, in a similar way to that surmised with the bundle of seven capillaries, the inflow of the gas is better organized and that possibly no entrance turbulences occur.

The technology for manufacturing multichannel plates is fully developed. There are commercial suppliers supplying multichannel plates with selectable channel diameters, selectable setting angles of the channels, selectable thickness, and selectable channel spacing. The multichannel plates can be supplied with a high-resistance coating on the channel walls and with metallic coating of the plate surfaces, as are supplied for secondary-electron multipliers.

DETAILED DESCRIPTION

The basic idea of the invention is to use a multichannel plate with thousands, usually even hundreds of thousands, of narrow and short microchannels for the inflow of a mixture of ions and gas into the vacuum instead of the single capillary that has usually been used until now. It is necessary to introduce ions into the vacuum for analysis in a mass spectrometer, since every mass spectrometric principle can only be carried out in a good vacuum, frequently only in a high vacuum or ultra-high vacuum (UHV).

The inflow of the mixture of ions and gas, which begins at pressures near atmospheric, ends initially in a first stage of a multistage differential pump system. In this first stage the ions have to be separated as far as possible from the gas flow and transmitted separately. When a single capillary is being used, this separation is usually done using a skimmer. The focused gas jet which emerges from the single capillary is directed toward the narrow passage opening of the skimmer. Most of the entrained gas is laterally deflected by the conical design of the skimmer, while a proportion of the ions are guided through the aperture of the skimmer into the next stage of the differential pump system, assisted by a suitably shaped electric guide field. The proportion of the ions passing through the skimmer opening is not high enough to be satisfactory.

Figure 1:
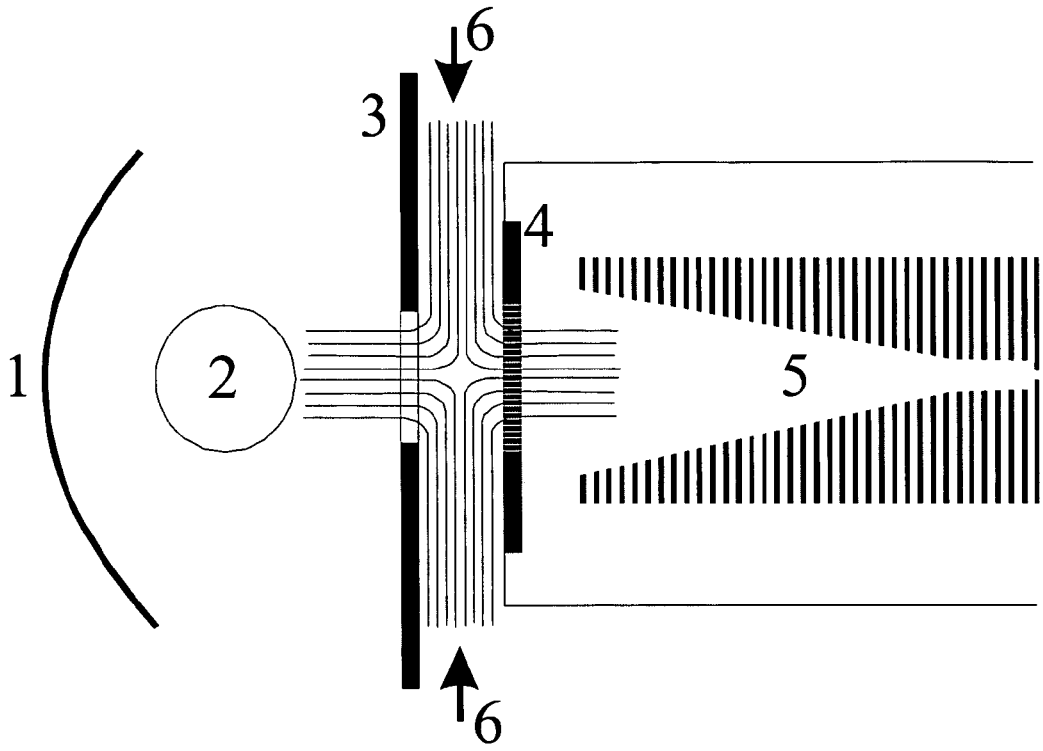
FIG. 1 illustrates an arrangement of an ion inlet system according to this invention with schematic representation of the stream of curtain gas (6), part of which enters the vacuum, and part of which flows toward the ion cloud (2). Behind the multichannel plate (4) is the ion funnel (5); in front of it there is a ring diaphragm (3), which serves both to guide the curtain gas and also to shape the potential distribution to guide the ions to the multichannel plate (4).
Figure 2:
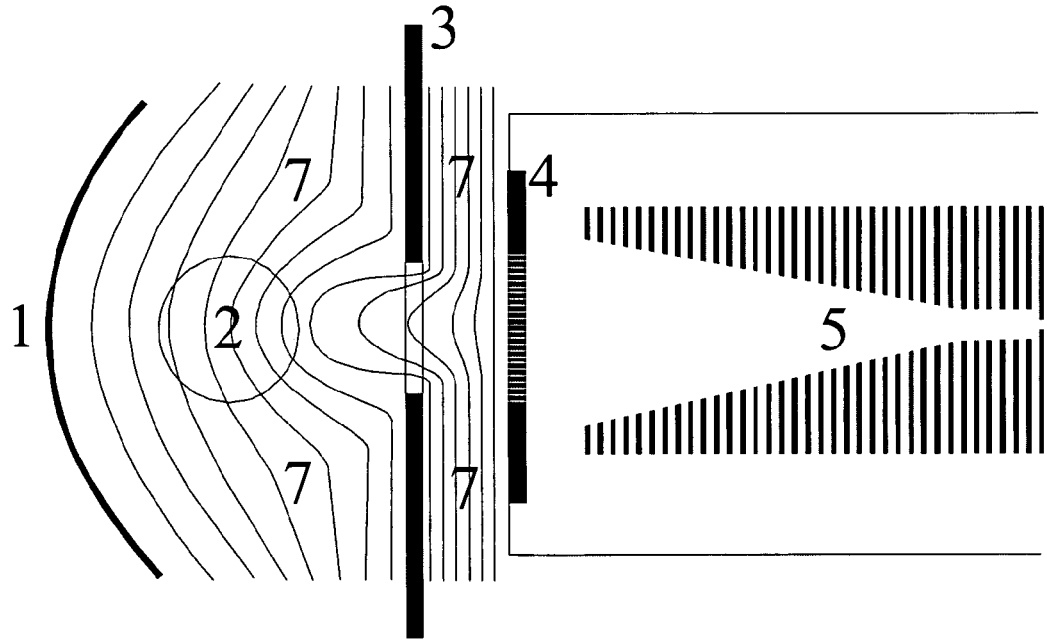
FIG. 2 illustrates the same arrangement, but with schematic representation of the equipotential surfaces of the potential distribution (7), whose purpose is to guide the ions from the ion cloud (2) to the multichannel plate (4). The ion mobility means that the ions always pass at right angles to these equipotential surfaces to the points of lowest potential, which in this case is on the surface of the multichannel plate (4).
Figure 3:
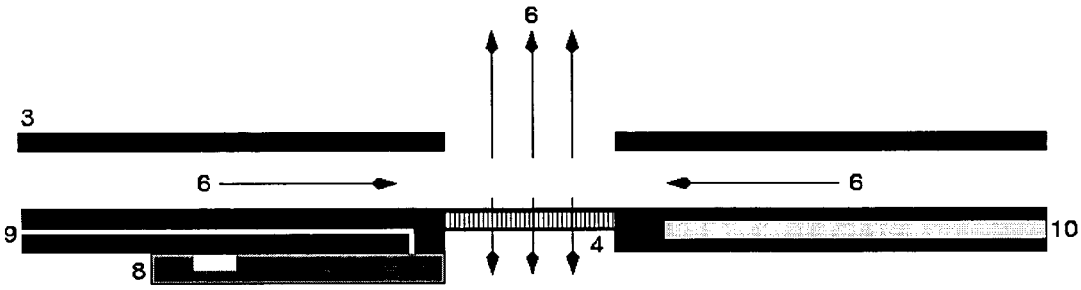
FIG. 3 schematically represents an arrangement by means of which a shut-off tab (8) can cut off the inflow of curtain gas (6) behind the multichannel plate (4). Moreover, the multichannel plate can be heated by a heating element (10).
Figure 4:
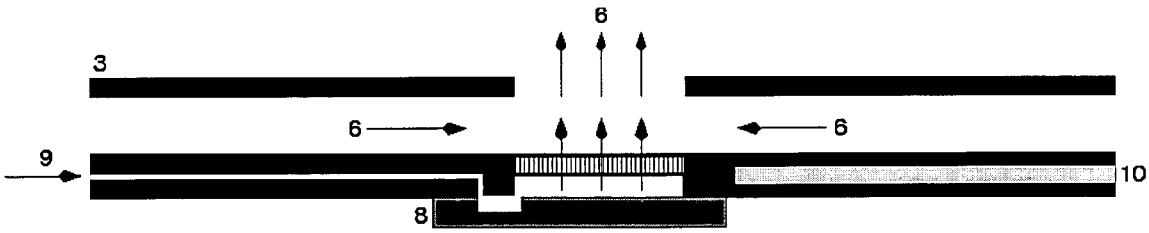
FIG. 4 depicts the shut-off state of the arrangement shown in FIG. 3. Here a gas channel (9) is opened, through which curtain gas can be fed. This gas then flows in the opposite direction through the multichannel plate (4), cleaning the plate of attached dust.

It is a particularly favorable embodiment of this invention to substitute an ion funnel (5) for the skimmer, which can no longer be used at all effectively with the now diffuse inflow through the multichannel plate (4). The ion funnel (5) consists of a large number of ring diaphragms arranged in parallel, whose apertures form a partially cylindrical, partially conical interior space. The two phases of an RF voltage (usually a few megahertz at a few hundred volts) are applied alternately to the ring electrodes across the funnel, and a quasi-continuously decreasing DC potential difference is applied across the ring electrodes from the entrance to the exit of the funnel. The RF voltage results in an ion-repelling pseudopotential at the interior wall and keeps the ions away from the funnel walls. The DC potential difference, which generates an axial voltage drop, guides them through the tapering cone of the ion funnel and through a small diaphragm to the next pump stage. Ion funnels have recently been described which no longer simply have a tapering cone, but rather use apertures that are no longer rotationally symmetric in shape to bring about a special focusing, and hence the passage of ions of a further mass range through a finer aperture into the next pressure stage. An impact plate in the ion funnel (5) (not shown in FIGS. 1 and 2) can prevent a gas jet forming and hence prevent gas flowing directly into the next pressure stage.

The ions have to be introduced into the vacuum because it is, in biomolecular analytics, becoming more and more common for the ions to be generated near atmospheric pressure. One of these ion generators is the electrospray ion source (ESI), but other ionization methods such as photoionization at atmospheric pressure (APPI) or chemical ionization at atmospheric pressure (APCI) with primary ionization by corona discharges or beta emitters (for example by $^{63}$Ni) must be listed here. Similarly, ionization by matrix-assisted laser desorption and ionization (MALDI), with or without further ionization aids, can also be operated at atmospheric pressure (AP-MALDI). All these ion sources generate a cloud of ions (2) in ambient gas outside the vacuum system.

The term "near atmospheric pressure" is to be understood here as meaning any pressure which brings about a viscous entrainment of the ions through the microchannels, i.e., any pressure considerably higher than about a hundred hectopascals. In this pressure range, the normal gas-dynamic laws hold true, and the viscous entrainment of ions prevails.

A particular embodiment consists in an arrangement of at least two multichannel plates one behind the other, between which gas can be evacuated at a relatively high intermediate pressure by a relatively small membrane pump. The roughing pump of the mass spectrometer can then be much smaller and its capacity can be reduced from 30 cubic meters per minute to three cubic meters per minute, for example. At the stage of the intermediate pressure, the ions are conducted relatively easily by an electric field between the two parallel multichannel plates from one multichannel plate to the other. Several multichannel plates can be used to optimize price and performance of the pump system. Smaller pumps, e.g. membrane pumps instead of rotary pumps, are also quieter, which improves the working environment in the laboratory.

As a rule, this mixture of gas with ions in the ion cloud (2) created in the out-of-vacuum ion sources is not introduced directly into the vacuum, since the ion cloud is usually still contaminated with other substances. A very clean curtain gas (6) is therefore fed in close to the introduction aperture(s), and this gas can be suitably heated and its moisture content controlled. Usually pure nitrogen is used as curtain gas. The ions are then transferred out of the originating cloud (2) by electric guide field lines (vertical to the equipotential surfaces 7) into the flowing curtain gas (6) and are aspirated with the gas into the vacuum. A sufficient quantity of the curtain gas (6) must be fed in so that not only the amount of gas aspirated through the multichannel plate (4) is available but also an excess flow of curtain gas which moves toward the ion cloud (2) and shields the multichannel plate (4) from contaminated gas.

When using the multichannel plate (4) it is advisable to feed in the curtain gas (6) from the edge of the plate, with symmetrical flow from all sides toward the center of the plate (4). In front of the multichannel plate (4) there is a cover electrode (3) with a round aperture, whose size roughly corresponds to the area of the multichannel plate (4) occupied by channels. The electric guide field of the potential distribution (7) consists of an ion-attracting potential on the surface of the multichannel plate (4), whose electric field extends through the cover electrode (3) into the ion cloud (2). The field (7) can be shaped further by external electrodes (1). The part of the curtain gas (6) which does not flow through the multichannel plate (4) into the vacuum, flows through the aperture of the cover electrode (3) toward the ion cloud (2).

The molar gas flow dn/dt through a capillary is described by Poiseuille's formula:

$$\frac{dn}{dt} = \frac{\pi r^4 (p_1^2 - p_2^2)}{16 \eta l R T},$$

where r is the inside radius of the capillary, l its length, $p_1$ and $p_2$ the gas pressures at the inlet and outlet of the capillaries, $\eta$ the viscosity of the gas, R the general gas constant and T the temperature. The gas flow therefore increases with the fourth power of the capillary radius r, and decreases linearly with the length l.

Compared to a single capillary with 0.5 millimeter inside diameter and 180 millimeters in length, a multichannel plate one millimeter thick can contain around $5.5\times10^5$ channels, each having an inside diameter of five micrometers, in order to produce the same gas flow into the vacuum. This even means that the length to diameter ratio of the microchannels of the multichannel plate is smaller, and therefore more favorable, for the passage of the ions. If an ion enters this type of microchannel of a multichannel plate centrally, and if this ion diffuses to the side with roughly the same angle of diffusion as in the single capillary, then in the microchannel of the multichannel plate its chance of entering the vacuum without coming into contact with the wall is many times higher. The speed of the gas in the microchannels of the multichannel plate is considerably reduced, so that the dwell time is not dramatically shorter than the dwell time in a single capillary. It is therefore to be expected that the behavior with regard to the desolvation will be roughly the same.

The multichannel plates can easily be contaminated by fine dust, however. It is therefore a further embodiment to make the gas entrance from the ion source to the vacuum closable either in front of or behind the multichannel plate. It is then possible to switch off the flow of pure curtain gas during breaks in operation, thus saving costs. The closing mechanism can also be such that the flow of the curtain gas through the microchannels can be reversed, enabling the microchannels to be cleaned again.

The number of ions which can pass through the multichannel plate and enter the vacuum undamaged per unit of time is much higher than with a single capillary because there are hardly any space charge effects in the multichannel plate. If there is only a single ion in each microchannel at any time, no space charge effect can occur. Since the dwell time of an ion in the microchannel is less than half a millisecond, if all microchannels have roughly the same occupancy, around one billion ions per second can enter the vacuum. Such a uniform occupancy will not occur, however. On the other hand, many ions can also dwell in a microchannel without any space charge effect if they are just several channel diameters apart. In a single capillary, an inflow of one billion ions per second would mean that some 10,000 ions would rush around in one millimeter of capillary, which, as experience with three-dimensional ion traps shows, must lead to a dramatic explosion of the space charge cloud; within a very short time the ions would be driven against the capillary wall, where they would be discharged.

The lack of a space charge influence means that the gas-dynamic focusing can operate with maximum effectiveness. This consists in decelerating the ions in the laminar gas flow by means of an electric field so that they adopt a slower transport speed than corresponds to the gas speed. The relative speed of the ions compared to the flowing gas, and hence the deceleration, is given by the laws of ion mobility under the influence of an electric field. As the ions decelerate, there is a laminar flow of gas all round them and, as a result, they undergo a gas-dynamic focusing toward the middle axis of the capillary, as described above.

This focusing effect is very weak. It exists only as long as high ion densities do not cause space charge fields which destroy the gas-dynamic focusing. The voltage required for gas-dynamic focusing in the multichannel plates is relatively low, and only a few tens of volts for microchannels one millimeter in length. The voltage is simply applied between the two metallized surfaces.

On the other hand, heavy ions drawn through the light curtain gas in the microchannels of the multichannel plate by an electrical potential difference in forward direction may result in a smaller angle of diffusion and may show statistically lower numbers of wall hits. This kind of operation excludes the gas kinetic focusing, but experiments show a tendency in this direction.

The feeding of the ions into each single microchannel of the multichannel plate can be significantly improved by forming a focusing ion mobility field in front of each microchannel. A favorable field for this feeding process can be achieved by a double metal layer, separated by an insulating layer, at the outside of the multichannel plate instead of a single metal layer. Both layers have apertures in front of each microchannel. The layers can be applied with different electric DC potentials. If a sucking potential is applied to the lower layer, forming a field reaching through the aperture in the upper layer, then the ions are drawn during the entering process towards the center of the microchannel thus increasing the probability to pass the microchannel.

In the last decade, multichannel plates have become a fully-developed product, mainly for use in two-dimensional secondary-electron multipliers. They are available in many forms. There are commercial suppliers who supply multichannel plates with selectable channel diameters, selectable setting angles of the channels, selectable thickness and selectable channel separation. The multichannel plates can particularly be supplied with a high-resistance coating on the channel walls and with metallic coating of the plate surfaces. This makes them ideally suited for use in gas-dynamic focusing.

Multichannel plates in themselves are very fragile. They can therefore be backed with a support grid to strengthen them. A fine support grid with perforations can be produced by etching a thin metal foil, for example; it is then very flat and provides good support for the multichannel plate.

The multichannel plate can also have significantly fewer microchannels than presented in the above examples, and still be designed so that many more ions enter the vacuum than is the case with a conventional single capillary. This allows the roughing pump of the vacuum system to be very much smaller and more reasonably priced than is required at present.

An advantage of the multichannel plates which must not be underestimated is that, compared to a single capillary, the infeed of ions into the vacuum can be much shorter, which in turn reduces the overall length of the mass spectrometer. It permits more efficient utilization of the ion path to the mass analyzer in the mass spectrometer.

The invention can be used not only with mass spectrometers with out-of-vacuum ion generation, but also for all other types of apparatus which use ions in a vacuum. With knowledge of this invention, those skilled in the art will easily be able to develop ion introduction systems for introducing ions into the vacuum for use in different types of application.

What is claimed is:

1. Method for the transport of ions from an ion cloud in a chamber containing a gas at a pressure near atmospheric pressure into a vacuum system, the method comprising:

(a) providing a multichannel plate with a plurality of microchannels between the chamber and the vacuum system; and (b) guiding the ions through the microchannels into the vacuum system.

2. Method according to claim 1, wherein step (b) comprises applying a potential difference across the microchannels of the multichannel plate in order to guide the ions through the microchannels into the vacuum system.

3. Method according to claim 1, further comprising:

(c) providing an ion funnel in the vacuum system in which the ions are received in order to separate the ions from gas flowing through the microchannels; and (d) by transmitting received ions via the ion funnel towards further pump stages of the vacuum system.

4. Method according to claim 1, wherein the ions from the ion cloud in the gas near atmospheric pressure are conducted, by virtue of their ion mobility, in an electric guide field to the multichannel plate.

5. Method according to claim 1, wherein a clean curtain gas is fed in from the edge of the multichannel plate on the atmospheric pressure side of the multichannel plate.

6. Method according to claim 5, wherein the curtain gas is heated.

7. Method according to claim 5, wherein the moisture content of the curtain gas is regulated or controlled.

8. Introduction system for ions in a chamber containing a gas at a pressure near atmospheric pressure into a vacuum chamber, the system comprising:

(a) a generator of ions in the chamber containing the gas near atmospheric pressure, and (b) a multichannel plate being located between the chamber containing the gas near atmospheric pressure and the vacuum chamber and having a plurality of microchannels through which pass a mixture of ions and gas into the vacuum chamber.

9. Introduction system according to claim 8, wherein the multichannel plate has more than a thousand microchannels.

10. Introduction system according to claim 8, wherein each of the plurality of microchannels has an inside diameter of less than ten micrometers.

11. Introduction system according to claim 8, wherein the multichannel plate is supported on the vacuum side by a support grid.

12. Introduction system according to claim 8, wherein each of the plurality of microchannels of the multichannel plate has a high-resistance coating.

13. Introduction system according to claim 8, wherein the multichannel plate has a metal conductive layer on both plate surfaces.

14. Introduction system according to claim 8, wherein at least one side of the multichannel plate carries a conductive double layer with an insulating layer in between.

15. Introduction system according to claim 8, comprising an ion funnel inside the vacuum separating out a proportion of the gas from the ions and transmitting the ions.

16. Introduction system according to claim 8, comprising a system of electrodes spanning an electric field which guides the ions from where they are generated in the gas to the multichannel plate.

17. Introduction system according to claim 8, comprising a gas supply unit delivering a curtain gas flow at the surface of the multichannel plate that prevents the penetration of contaminants into the vacuum.

18. Introduction system according to claim 8, comprising a valve located between the chamber containing the gas near atmospheric pressure and the multichannel plate to prevent gas from flowing through the multichannel plate during breaks in operation.

19. Introduction system according to claim 18, wherein the valve for cutting off the gas stream of the multichannel plate is located on the vacuum side of the multichannel plate, and wherein the valve contains means for reversing the gas stream through the multichannel plate.

20. Introduction system according to claim 8 further comprising:

a second multichannel plate located between the multichannel plate and the vacuum chamber and separated from the multichannel plate by a space that is connected to a vacuum pump; and a voltage supply connected to the multichannel plate and to the second multichannel plate so that ions are guided between the multichannel plate and the second multichannel plate by an electric field.

* * * * *